US005290600A

United States Patent [19]

Ord et al.

[11] Patent Number: 5,290,600

[45] Date of Patent: Mar. 1, 1994

[54] APPARATUS AND PROCESS FOR PRODUCING SHEETS OF MATERIAL

[75] Inventors: Stuart C. Ord, Chester; Timothy J. Noakes, Clwyd, both of Great Britain

[73] Assignee: Imperial Chemical Industries PLC, London, England

[21] Appl. No.: 787,958

[22] Filed: Nov. 5, 1991

[30] Foreign Application Priority Data

Nov. 12, 1990 [GB] United Kingdom ..... 9024548.1

[51] Int. Cl.[5] ..... B05D 1/04; B05D 1/30

[52] U.S. Cl. ..... 427/472; 222/566; 427/420; 427/473

[58] Field of Search ..... 427/13, 420, 472, 473; 222/566

[56] References Cited

U.S. PATENT DOCUMENTS 4,403,566 9/1983 Bloothoofd ..... 118/407
4,749,125 6/1988 Escallon et al. ..... 239/3

FOREIGN PATENT DOCUMENTS 0186983 3/1989 European Pat. Off. .
0454613 7/1968 Switzerland .
1281512 7/1972 United Kingdom .

*Primary Examiner*—Bernard Pianalto
*Attorney, Agent, or Firm*—Cushman, Darby & Cushman

[57] ABSTRACT

Apparatus and method for projecting liquid in the form of a sheet for deposition on a target comprises a nozzle having a slot 10 of width not less than 250 microns to which the liquid is supplied. High voltage is applied to the liquid and the liquid is supplied to the slot at a flow rate such that the liquid is formed as, and is maintained in the form of, a sheet by preponderantly electrostatic forces thereby effecting deposition of the sheet on to the target.

10 Claims, 2 Drawing Sheets

APPARATUS AND PROCESS FOR PRODUCING SHEETS OF MATERIAL

This invention relates to apparatus for producing sheets of material.

Apparatus is disclosed in British patent specification No. 1281512 in which a coating is applied to an article as a curtain of liquid. The apparatus comprises a nozzle having a path for feeding a liquid via a liquid contacting, conducting surface to an edge; and means for charging the conducting surface to a high voltage. Two reactive liquids meet to form the curtain as they leave the edge from which they fall by gravity.

Charging the conducting surface to a high voltage applies an electrostatic field to liquid at the edge to induce mixing of the two liquids. Curtain coaters suffer the disadvantage that, since the curtain falls under gravity, they can only operate downwards. Further, they can only operate with relatively non-viscous liquids of, perhaps, a few poise. Additionally they are suitable only for forming relatively thick coatings above, say, 60 microns thickness.

Another apparatus for producing a sheet is a slot die. These suffer the disadvantage that, for coatings, they have to be positioned very close, e.g. 10 microns, to an article to be coated. Again, they can only be used with relatively non-viscous liquids e.g. below a few poise unless the engineering is massive.

It is also known from Swiss Patent No. 454613 to apply liquid coating mixtures to flat substrates by a meniscus or wave coating technique in which the liquid is coated from a slit-like aperture arranged close to the moving substrate to be coated and an electrostatic field is maintained between the liquid mixture fed to the aperture and an electrically conductive component which is arranged in contact with the rear side of the substrate. In a conventional meniscus or wave coating apparatus, the substrate is advanced close to the surface of supply of the coating mixture and the level of the liquid is raised to form a meniscus or wave so that the liquid is caused to adhere to the substrate. This requires accurate control of the liquid level in order to avoid detachment of the coating wave from the substrate. According to Swiss Patent No. 454613, the accuracy with which the liquid level has to be controlled in meniscus or wave coating can be made less critical, with consequent simplification in the level controlling means, if an electrostatic field is produced so as to form the liquid meniscus or wave between the aperture and the substrate.

Aperture widths of 0.1, 0.3, 0.5 and 0.9 mm are disclosed and the aperture is disclosed as being located at distances of 0.5 and 0.7 mm from the substrate. The aperture to substrate spacing is stated to be of importance in determining coating speeds and the thicknesses of the deposited layers of liquid mixture. In particular, if higher coating speeds are to be achieved, the aperture/substrate spacing should be reduced and to increase the thickness of the deposited layer, the aperture/substrate spacing should again be reduced.

In another art, apparatus is described in EP-B1-186993 for producing a spray of droplets. The apparatus has a nozzle having a path for feeding a liquid via a liquid contacting, conducting or semiconducting, surface to an edge; and means for charging the conducting or semiconducting surface to a high voltage. The path includes a passage terminating at a slot at the edge or spaced therefrom by a delivery surface.

In accordance with the invention there is provided apparatus for producing a sheet of material, comprising:

a nozzle having a path for feeding a liquid via a liquid contacting, conducting or semiconducting, surface to an edge, said path including a passage terminating at a slot at the edge or spaced therefrom by a delivery surface and the slot having a width of at least 250 microns;

means for charging the conducting or semiconducting surface to a high voltage; and means for supplying liquid to the slot at a flow rate such that the liquid is formed as, and is maintained in the form of, a sheet by preponderantly electrostatic forces and is projected as a sheet from the nozzle.

Also according to the invention there is provided a process for producing a sheet of material, comprising feeding a liquid to an edge and producing at the edge an intense electric field, the flow rate of the liquid being sufficiently high and the electric field being sufficiently intense that liquid is projected in the form of a sheet from the edge preponderantly by electrostatic forces.

In contrast with the meniscus or wave coating apparatus of Swiss Patent No. 454613, it will be seen that the apparatus and process of the invention involve forming the liquid as a sheet which is maintained as a sheet by electrostatic forces as it traverses the spacing between the nozzle slot and the target. In the present invention, the liquid is initially drawn by the electrostatic field into a cusp-like section which, under the acceleration forces exerted by the field, thins into a film or sheet.

Normally, the liquid will have a resistivity in the range $5\times10^6$ to $5\times10^{10}$ ohm cm.

The apparatus may be used with or without field modifying electrodes. Without the electrodes the advantage is that the electric field accelerates the sheet all the way to a target.

The sheet is preferably projected towards the target with the assistance of gravity.

The apparatus can be used to produce thinner sheets than can be produced by a curtain coater and can be used with relatively viscous liquids, e.g. the preferred minimum viscosity is 5 poise. In a particular example, Dynaclear (which is a coating liquid marketed by Chemical Industries Limited of Canada for use as a motor vehicle body clearcoat, the liquid having a composition based on acrylate resins and melamine formaldehyde resins in mixed ester solvents, the overall non-volatile content being of the order of 70%) having a viscosity of 10 poise, formed a sheet at a minimum flow rate of 20 cc per centimetre of edge length per minute. In another particular example, Evostic, an adhesive having a viscosity of 100 poise formed a sheet at a minimum flow rate of 6 cc per cm edge length per minute. In selecting liquids and flow rates suitable for use in the invention, due regard must be had to the visco-elastic behaviour of the liquid. For example, Dynaclear is readily formed into a sheet at flow rates above 20 cc per centimetre of edge length per minute whereas a Newtonian liquid such as a mineral oil having a viscosity of 10 poise would require a much larger flow rate for sheet formation than Dynaclear.

The spacing between the nozzle and a target is not critical subject to ensuring that the liquid is formed as, and projected as, a sheet. A normal distance would be no less than 4 mm, say 2 cm between the nozzle and the target. However, it is possible, for example, to place the nozzle 12 cm from the target without the sheet breaking up, provided the electric field is maintained high enough at the edge, for example by raising the voltage.

In distinction from a spraying apparatus, the sheet is only formed when, for a given viscosity, the flow rate of the liquid is much higher than the rate at which spraying occurs. The higher the viscosity, the lower the actual flow rate to produce a sheet. Never the less, at high viscosities, the flow rate to produce a sheet is still much higher than that to produce spraying at the same viscosity. In a spraying apparatus, the width of the slot is much narrower and it would not be practical to obtain the high flow rate required at a given viscosity to produce a sheet. Further, as the flow rate is increased the quality of spray deteriorates to the point where it becomes totally uninteresting to investigate the effect of further increases which would require a nozzle having a wider slot.

For spraying droplets, we find, in our unpublished research, that a normal slot width would be in the range 20 to 195 microns with a typical example being 125 microns.

The only purpose in increasing the slot width would be to increase the flow rate of the liquid. With a slot width of 195 microns, the flow rate can already be increased to a level at which the spray is exceedingly poor in quality, consisting of relatively few ligaments. Spraying technology would not need a wider slot and use of a wider slot at flow rates suitable for spraying would tend towards uneven distribution of the liquid along the slot, especially if the spray is not directed straight down. As flow rate increases, spraying quality deteriorates. The maximum flow rate at which the spray still has some value is, perhaps, 20% of that at which the transition from (very poor quality) spraying to sheet formation occurs.

In contrast to slot dies, apparatus in accordance with the invention has a slot width which is much larger than and not related to the thickness of the sheet of liquid. This means that it is not necessary to use the high pressures necessary in slot dies. Gravity feed can be used. A maximum pressure might be about 20 psi. This enables the apparatus to be constructed of plastics, or plastics composite material instead of the massive stainless steel engineering necessary in the prior art.

To facilitate the production of a sheet of even thickness, the slot is preferably not divided.

Further to facilitate production of a film of even thickness, the conducting or semiconducting surface and the delivery surface are separate, the conducting or semi-conducting surface being inside the passage and the delivery surface being non conducting. As the delivery surface is non conducting, there is a voltage gradient across it which implies a field to accelerate the liquid across the delivery surface. We find this arrangement gives somewhat stabler thinner sheets.

Embodiments of the invention will now be described with reference to the accompanying drawings, in which:

FIG. 1 is a cross section of apparatus for producing a sheet, embodying the invention showing the liquid supply path;

FIG 1*a* is an enlarged detail of FIG. 1;

Figure 1:
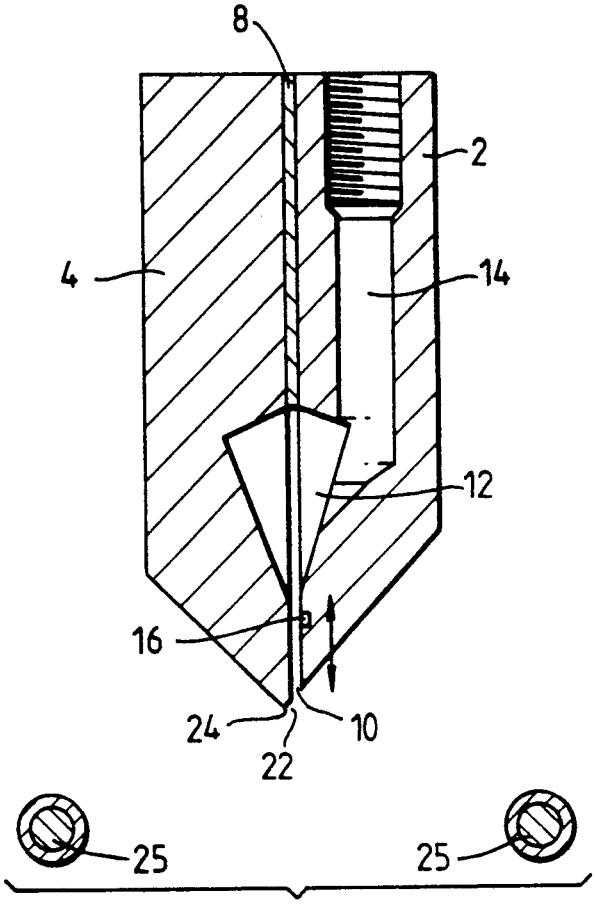
Figure 2:
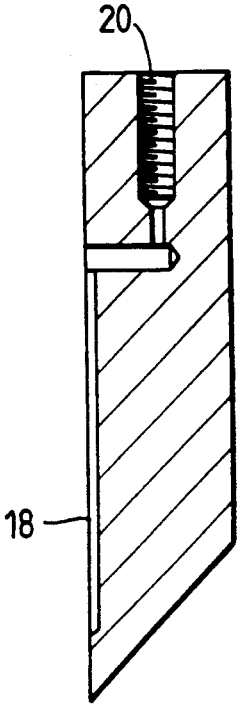
FIG. 2 is a cross section of part of the apparatus of FIG. 1, showing the electrical connections.
Figure 1A:
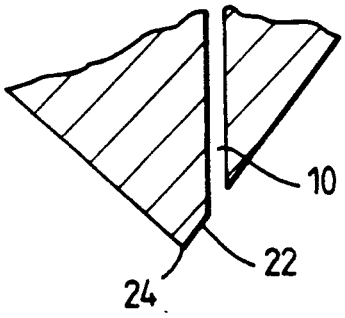
Figure 3:
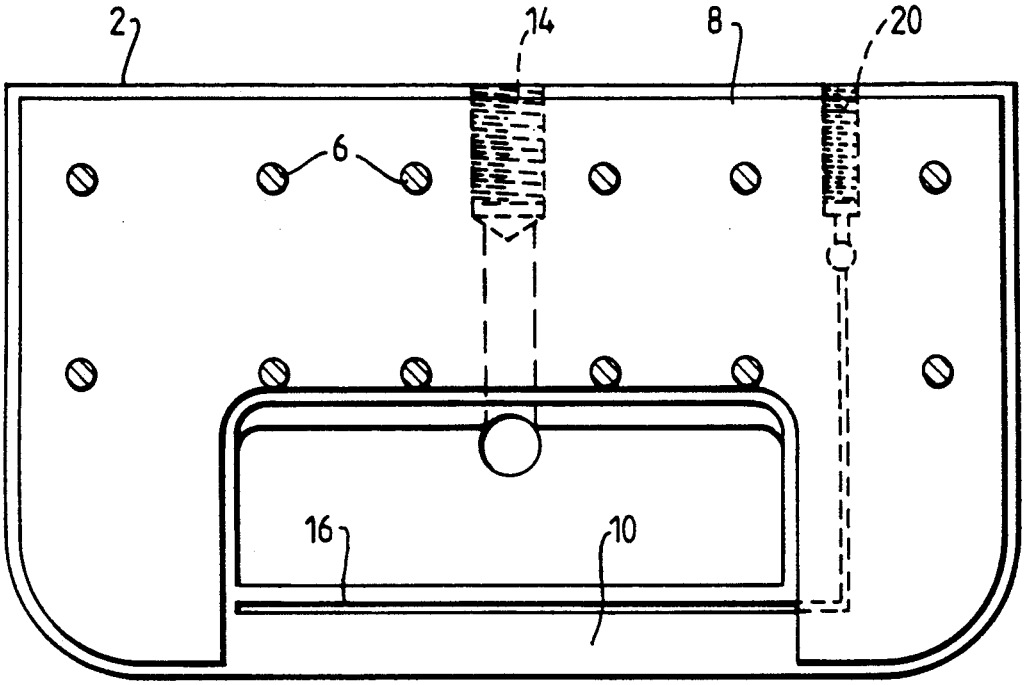
FIG. 3 is a plan view of part of the apparatus of FIG. 1.

The apparatus illustrated in FIG. 1, comprises two parts 2 and 4 bolted together through holes 6 (shown in part 2 but not shown in part 4) and sandwiching a gasket 8 shown in broken outline in FIG. 3. The gasket defines the width of a slot 10 and seals the parts 2 and 4 together except at the slot. The particular material preferred for the gasket is sheet Melinex. The width of the slot is shown out of scale with the rest of the drawing, being overly large. Even so, the slot is at least 250 microns which is relatively large compared with what would be used in electrostatic spraying in which ligamentation is produced electrohydrodynamically. For spraying the flow rate is much lower for a given viscosity of the liquid.

Behind the slot, both parts are indented to form a distribution gallery 12. The gallery 12 connects with a cylindrical supply passage 14 in the part 2. The distribution gallery 12 is large compared with what would be required in a sprayer, so that liquid supplied via the passage 14 is distributed evenly to the slot 10. To achieve even distribution along the slot the hydraulic pressure drop as liquid flows through the slot, i.e. downwards in FIG. 3, has to be large compared with the pressure drop along the gallery 12, that is to say to the left and to the right in FIG. 3.

It is possible to make the parts 2 and/or 4 from conducting material for connection to a high voltage generator (not shown). However, we prefer to make both parts from an insulating or semi-insulating material. An example of a semi-insulating material is a paper/phenol formaldehyde resin composite e.g. Tufnol Kite Brand. A conducting or semiconducting surface 16 is provided inside the slot 10 by a conducting material (e.g. metal) or semiconducting material 18 inlet into the surface of the part 18 and connected to an electrical terminal at 20.

In use liquid is supplied to the passage 14 and passes through the distribution gallery 12 to the slot 10. In the slot 10 the liquid is contacted by the conducting or semiconducting surface 16 which is connected to the output of a high voltage generator (not shown). Ignoring temporarily the optional electrodes 25, if the surface 16 is connected to the negative terminal of the high voltage generator, the other terminal being connected to earth, positive ions are conducted away from the liquid by the surface 16 leaving a net negative charge on the liquid.

In front of the slot 10 is a delivery surface 22 over which liquid leaving the slot flows to an edge 24.

Flowing over the delivery surface helps to even out the flow along the nozzle, stabilises and produces a thinner sheet. The liquid is sufficiently conducting that an intense electrical field is formed at the edge 24 when this is covered with liquid. Sheet formation depends on having a sufficiently high electrical field intensity. With the nozzle at a distance of 2 cm from an earthed target, a voltage in the range 35 to 40 Kv is satisfactory.

An advantage of this arrangement, without the electrodes 25, is that there is an electric field all the way from the nozzle to the target which helps keep the sheet under control.

In an alternative arrangement, electrodes 25 are provided near the nozzle to modify the electric field. The electrodes are tubes of semi-insulating material forming sheaths over a conductive core. The semi-insulating material has a specific resistance in the range $5\times10^{10}$ to $5\times10^{12}$ ohm cm. Examples of such materials are: soda glass; paper/phenol formaldehyde resin composite e.g. Tufnol Kite Brand; melamine formaldehyde condensation polymer. The electrical connection to each electrode is made to the conducting core. As is explained in EP-B1-186983 the semi-insulating sheath enables the electrical stress between nozzle and the the electrode to be increased beyond what would be possible without the sheath. Normally, the electrodes 25 will be at earth potential or of the same polarity as, but lower voltage than, the nozzle. Positions can be found for the electrodes 25, such that the electric field at the nozzle is largely defined by the potential difference between the electrodes 25 and the nozzle, and such that the sheet is projected past the electrodes to the target. This may have advantages if the distance between the nozzle and the target is not constant.

In another alternative in which the bulk of parts 2 and 4 are insulating or semi-insulating, the conducting or semiconducting surface may be inset in the tip of the part 4 so that the edge 24 is conducting.

Given a liquid of a particular viscosity, sheet formation also depends on flow rate. Using nozzle having a 3 cm edge and a liquid having a viscosity of about 20 poise, which is higher than a curtain coater or slot die would normally use, we found the maximum flow rate to obtain spraying of tolerable quality was approximately 10 cc/m. In contrast the minimum flow rate at which the transition to sheet formation occurred, was 50 cc/m. This much larger flow rate is accommodated by the use of a slot 10 which is much larger than the widest slot necessary to accommodate the flow rate required for spraying. It would not be practical to use a normal spraying nozzle at such high flow rates. The very high pressure which would be necessary would have two effects. One is that it would distort or break the nozzle. The other is that at delivery pressures above 10–15 psi, the liquid would dissolve sufficient air that when the liquid leaves the nozzle bubbles would form in the sheet.

In order to facilitate the production of a sheet of even thickness, the width of the slot is maintained as accurately as practical. It would be a convenient to support the walls of the slot by spaced fingers in the gasket 8. However it has been found that such fingers also interfere with the evenness of the sheet and, as can be seen in FIG. 3 the slot 10 is undivided. This leads to the parts 2 and 4 being constructed much more massively than would be necessary for a sprayer.

Figure 4:
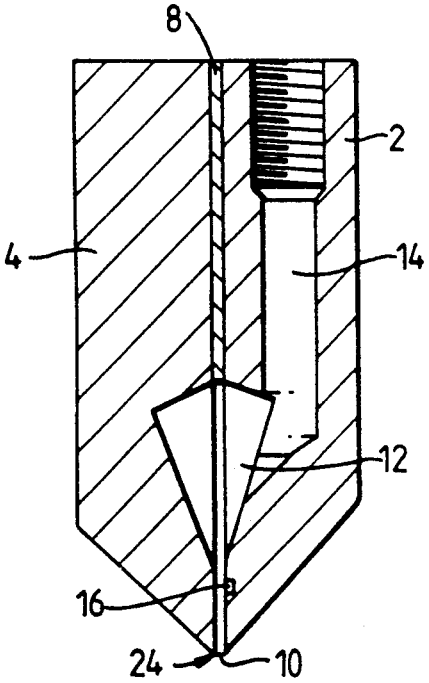
FIG. 4 is a cross section similar to FIG. 1 of an alternative embodiment.

Although the use of a delivery surface 24 is preferred, it is not essential. The two parts 2 and 4 may have identical tip forms, as shown in FIG. 4, so as to define between them an edge 24 with a slot 10 in its tip. Although such an arrangement may appear to have two edges, when the slot is bridged by the liquid, it functions as one edge producing one sheet. Two separate edges would produce two sheets if they could be made to function.

In an alternative arrangement (not shown) the conducting or semiconducting surface 16 is placed right at the tip of the delivery surface 22, so that the edge 24 is conducting or semiconducting.

Figure 5:
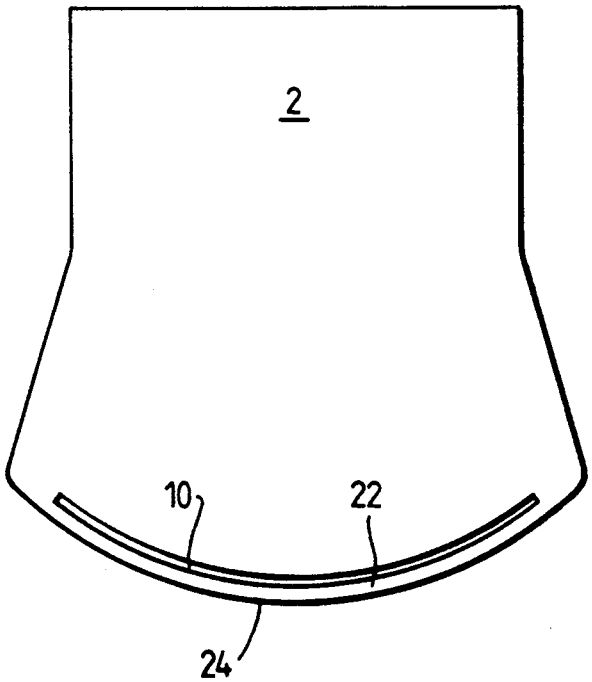
FIG. 5 is a plan view of an assembled further embodiment of the invention.

The edge of the nozzle illustrated is plane and linear. It is possible for the edge to be curved e.g. circular, or part circular in the sense that the section in FIG. 1 is rotated about a vertical axis to the right or left of the edge 24. In this example, the slot 10 then becomes an annulus or a part thereof. It is also possible to make the edge curved in the plane of the gasket and thus the sheet, e.g. by rotating the section shown in FIG. 1 about a horizontal axis displaced from the edge 24. Such an arrangement is illustrated in FIG. 5. This has a convex quadrant shaped edge which was found to exhibit the property that the width of the sheet produced over a flat target, was variable by varying the voltage applied to the surface 16. In another alternative the convex edge in FIG. 5 is concave and may be a complete inwardly facing circle.

As can be seen in both FIGS. 3 and 5 the edge 24 terminates in a large radius of curvature at opposite ends. This is to prevent corona discharge which may be produced by the higher electrical stress which would result from the edge terminating in sharp corners. Examples of liquids which may be used in the apparatus are: polyurethane adhesives, polyester, non-aqueous paints, moisture cured polymers, polymer melts, encapsulants, foam which is already blown.

The apparatus and method described herein is useful in a variety of applications where a liquid coating is to be applied to a target in the form of a sheet. One such application is in applying line markings to the ground, for example for producing traffic markings on roads or defining parking spaces in a parking lot. In this instance, the apparatus is conveniently mobile so that as it is moved over the surface to be marked, the coating material is applied to the ground in sheet form to produce continuous lines.

We claim:

1. Apparatus for producing a sheet of material, comprising:

a nozzle having a path for feeding a liquid via a liquid contacting, conducting or semiconducting, surface to an edge, said path including a passage terminating at a slot at the edge or spaced therefrom by a delivery surface and the slot having a width of at least 250 microns;

means for charging the conducting or semiconducting surface to a high voltage; and means for supplying liquid to the slot at a flow rate such that the liquid is formed as, and is maintained in the form of, a sheet by preponderantly electrostatic forces and is projected as a sheet from the nozzle.

2. Apparatus as claimed in claim 1, wherein the slot has a width of at least 500 microns.

3. Apparatus as claimed in claim 1 or 2, wherein the slot is not divided.

4. Apparatus as claimed in claim 1, wherein the conducting or semiconducting surface and the delivery surface are separate, the conducting or semiconducting surface being inside the passage and the delivery surface being non conducting.

5. Apparatus as claimed in claim 1, in which the edge is curved.

6. Apparatus as claimed in claim 5, in which the edge is plain in the plane of the sheet.

7. Apparatus as claimed in claim 1, wherein the edge terminates in a large radius of curvature at two opposed ends.

8. A process for producing a sheet of material, comprising feeding a liquid to an edge and producing at the edge an intense electric field, the flow rate of the liquid being sufficiently high and the electric field being sufficiently intense that liquid is drawn by the electrostatic field into a cusp-like section which, under the acceleration forces exerted by the electrostatic field, thins into a sheet which is projected as such from the edge.

9. A process as claimed in claim 8 comprising projecting the sheet so formed towards a target.

10. A process as claimed in claim 9 in which the sheet is deposited on the target while moving the edge in spaced relation with the target.

* * * * *